US010876264B1

(12) United States Patent
Turner

(10) Patent No.: US 10,876,264 B1
(45) Date of Patent: Dec. 29, 2020

(54) WASTE COLLECTION DEVICE

(71) Applicant: Scott W. Turner, Kalamazoo, MI (US)

(72) Inventor: Scott W. Turner, Kalamazoo, MI (US)

( * ) Notice: Subject to any disclaimer, the term of this patent is extended or adjusted under 35 U.S.C. 154(b) by 0 days.

(21) Appl. No.: 15/929,790

(22) Filed: May 21, 2020

(51) Int. Cl.
*E01H 1/12* (2006.01)
*A45F 5/02* (2006.01)

(52) U.S. Cl.
CPC ..... *E01H 1/1206* (2013.01); *A45F 5/021* (2013.01); *E01H 1/12* (2013.01); *E01H 2001/128* (2013.01); *E01H 2001/1226* (2013.01)

(58) Field of Classification Search
CPC . E01H 1/12; E01H 1/1206; E01H 2001/1226; E01H 2001/128; A45F 5/021
USPC ..... 294/1.3
See application file for complete search history.

(56) References Cited

U.S. PATENT DOCUMENTS 4,477,111 A * 10/1984 Crooks ..... E01H 1/1206 294/1.4
4,747,633 A 5/1988 Stacy
5,540,469 A 7/1996 Albert
6,059,332 A * 5/2000 Beascoechea Inchaurraga ..... E01H 1/1206 294/1.3
6,964,361 B2 * 11/2005 Kathrein ..... A45C 1/04 224/183
8,292,338 B1 * 10/2012 Baghdasaryan ..... E01H 1/1206 294/1.3
8,833,816 B2 * 9/2014 Hoffman ..... E01H 1/1206 294/1.3
9,091,031 B2 * 7/2015 Naseem ..... E01H 1/1206
9,181,667 B2 * 11/2015 Kaufman ..... E01H 1/1206
2009/0039129 A1 * 2/2009 Peterson-Malesci ..... A01K 27/003 224/682
2016/0143427 A1 * 5/2016 Stevens ..... A45F 5/021 224/183
2018/0063306 A1 * 3/2018 Scannell, Jr. ..... A45C 1/06

* cited by examiner

*Primary Examiner* — Dean J Kramer
(74) *Attorney, Agent, or Firm* — Timothy Murphy

(57) ABSTRACT

A collection device for objects in the form of a handheld claw comprising receptacles into which a user can insert fingers to move the claw into an open or a closed position, a lever which locks the claw in a closed position once the claw closes around an object, and a holster for securing the device to a belt or other object. The claw is configured to accept a bag and to releasably secure the bag around the object.

17 Claims, 3 Drawing Sheets

WASTE COLLECTION DEVICE

BACKGROUND

The present device relates to the technical field of collecting objects, such as animal waste. Various animal waste collection devices are available on the market. Many of these devices are bulky and contaminated with odorous residue after use.

When taking an animal for a walk, users of these devices must carry the devices with them until they return home. A need exists for a device which enables the user to keep his hands free during a walk with a pet.

One pertinent reference, U.S. Pat. No. 4,747,633, discloses a disposable claw which a user can open and close around animal waste. The user discards the claw along with the waste it contains after a single use. Another pertinent reference, U.S. Pat. No. 5,540,469, discloses a waste containment device with a handle. A user may insert a bag already containing animal waste into this containment device.

The present device permits an animal owner to walk his animal and collect any waste the animal generates while keeping his hands free throughout the walk, except when the disclosed device is in use. The device disclosed herein enables a user to securely enclose animal waste within a bag, which is contained within a claw. In some embodiments, the closed claw can be attached to a holster on the user's belt without the animal waste contaminating the holster, the claw, the user or the user's apparel. Even after disposal of the animal waste and the bag containing the waste, the claw may remain clean and hygienic. Typical use of the disclosed device in conjunction with a disposable bag avoids contamination of the disclosed device with animal waste residue.

SUMMARY

A waste collection device is described comprising a claw, a bag sealer, and a holster. The claw has a base region and appendages. Each appendage has a proximal end, a distal end, and an exterior surface, and the proximal ends of the appendages are connected to each other in the base region of the claw. Each appendage has a receptacle configured to accommodate a part of a user's hand. The claw is operable between a first position and second position. In the first position the distal ends of the appendages are disunited, and in the second position they are united. The bag sealer has a receiving member fixed to the exterior surface of one appendage and an advancing member fixed to the exterior surface of a second appendage. The receiving member and the advancing member are releasably securable to each other. The holster has a first portion capable of releasably securing the claw and a second portion configured to releasably secure to another object.

In some embodiments, the advancing member pivots between a first and second position. Moreover, in some embodiments, the advancing member may not touch the receiving member in the first position but may be releasably secured to the receiving member in the second position, such as with a magnet. The advancing member may have an exterior surface with a flange protruding from it.

Furthermore, some embodiments may have a holster with a first portion that comprises a magnetic portion. Similarly, some embodiments may have a holster with a second portion that is configured to releasably secure the holster to an article of clothing, and which may, in some embodiments, comprise a magnetic portion.

Some embodiments of the device may comprise an exterior surface on the claw where a portion of that exterior surface is configured to releasably secure the claw to another object. This portion on the exterior surface of the claw may be a magnet.

Some embodiments may comprise an actuator fixed to the exterior surface of an appendage, or alternatively, fixed to the exterior surface of the claw. This actuator is operable between a first position and a second position, and it moves the advancing member of the bag sealer as it moves or pivots between the first position and second position. Some embodiments also may comprise a flange attached to the advancing member which causes the advancing member to return from its second position back to its first position when the advancing member is not secured to the receiving member. Similarly, some embodiments may comprise a retracting member secured to the actuator and the advancing member, which causes the actuator to return from its second position back to its first position when the user of the device is not applying a force to the actuator. This retracting member is attached to both the advancing member and the appendage to which the advancing member is attached.

Additionally, some embodiments of the device may have a plurality of adhesive portions fixed to the claw's exterior surface. Some embodiments may comprise a bag disposed within the claw sufficient to contain the device. Likewise, some embodiments may have a bag dispenser fixed to the base region of the claw, with an aperture on the surface of the dispenser which is configured to receive a roll of bags.

BRIEF DESCRIPTION OF DRAWINGS

The following detailed description is provided to be read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
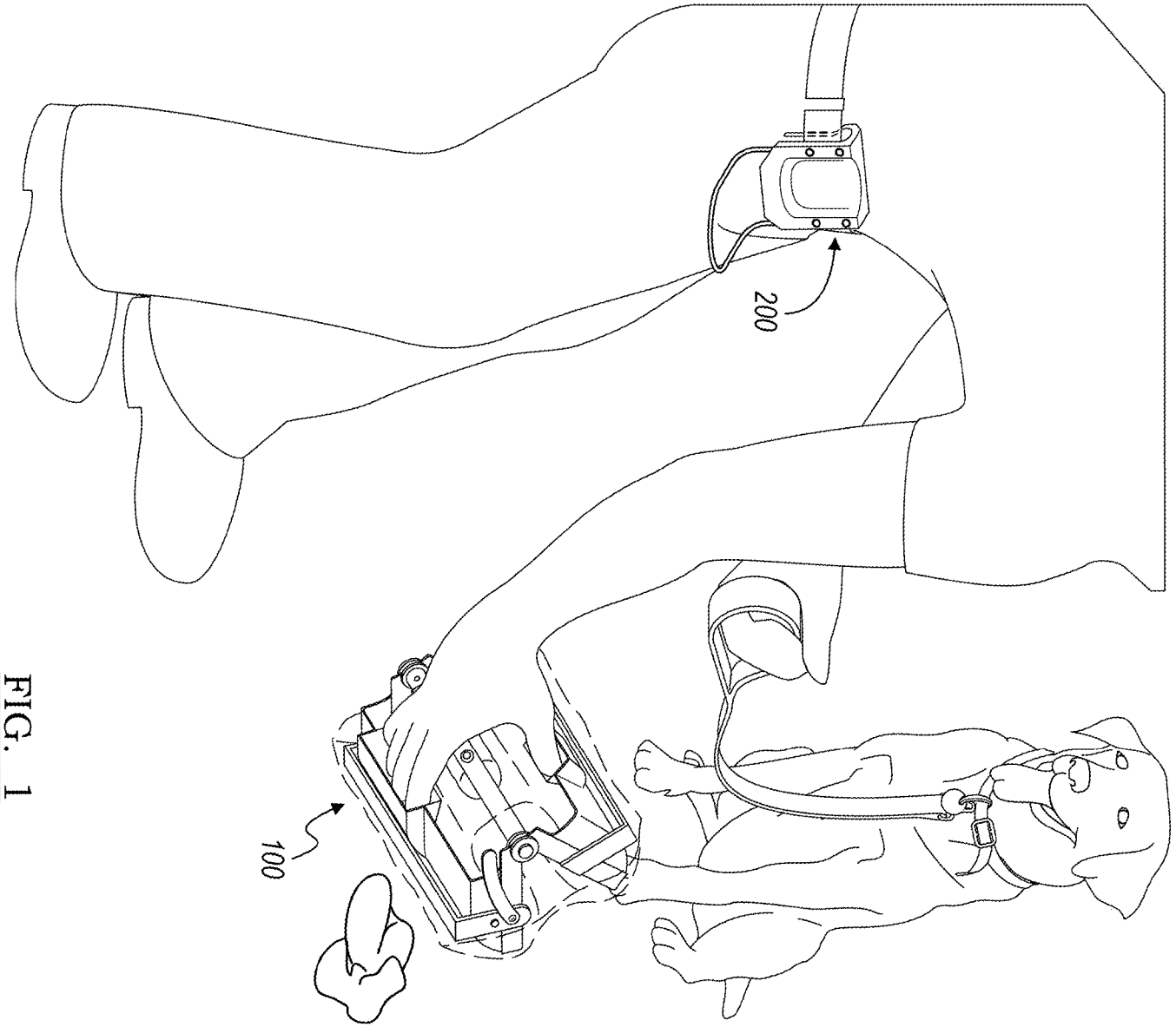
FIG. 1 shows one embodiment of the disclosed device in action.

FIG. 1 depicts a person using one embodiment of the disclosed device to collect a piece of animal waste. Both the claw and holster, and all their components, may be produced from a variety of different materials, including plastic, metal, wood, leather, synthetic or natural fabrics, composite materials, or any combination of these materials. If the claw or holster comprises metal components, these metal components may be produced by metal fabrication techniques, including folding, welding, forging, machining, punching, shearing, stamping, cutting, or casting. If the claw or holster comprises plastic components, these components may be produced by three-dimensional printing, extrusion molding, injection molding, or other manufacturing processes. Alternatively, if the claw or holster comprises wooden components, wood glue, screws, nails, or fasteners may be used to assemble the components of the device.

Figure 2:
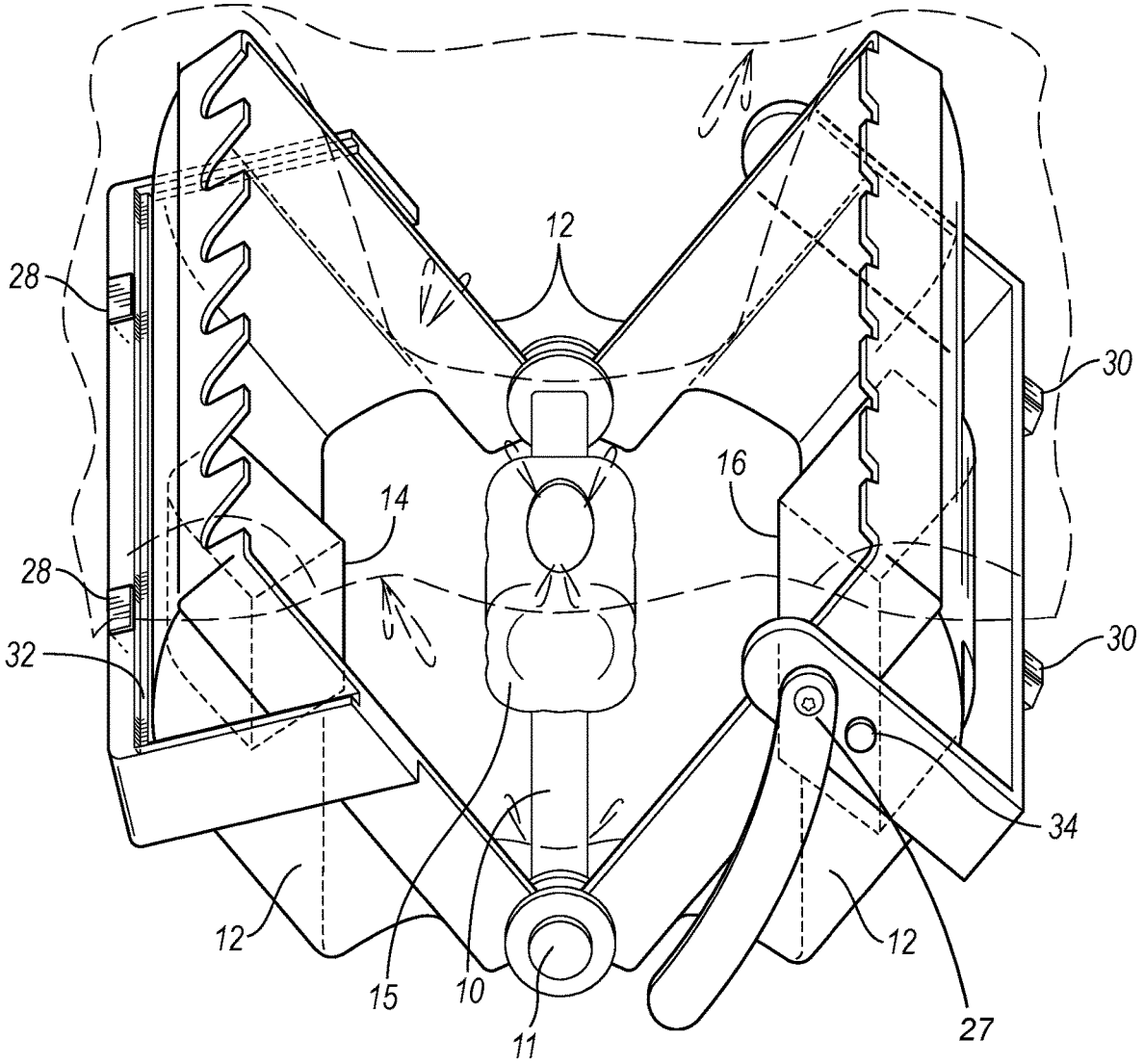
FIG. 2 shows a top view of one embodiment of the disclosed device in its open position.

FIG. 2 depicts one embodiment of the disclosed device in its first, or open, position. In this embodiment, the claw comprises two appendages 12 which open and close in a jaw-like movement, connected by a cross-bar 10 in the base region of the claw, which permits the appendages 12 to pivot. On the device depicted in the FIG. 2, both appendages 12 comprise a receptacle 14, 16 sized to accommodate a user's thumb or fingers. The cross-bar 10 provides structural rigidity to the claw and a surface to which a bag dispenser 15 and appendages 12 may be attached. Other embodiments may not require a cross-bar if the base region of the claw is composed of flexible materials which bend or give, such as leather or fabric.

Also depicted in FIG. 2 is a bag dispenser 15 attached to the cross-bar 10 in the claw's base region. The bag dispenser 15 in FIG. 2 is sized to contain a roll of disposable bags, and the bag dispenser's aperture is sized to permit dispensing of bags one at a time. The bag dispenser 15 may be created from any materials mentioned above, including synthetic or natural fabrics.

Figure 3:
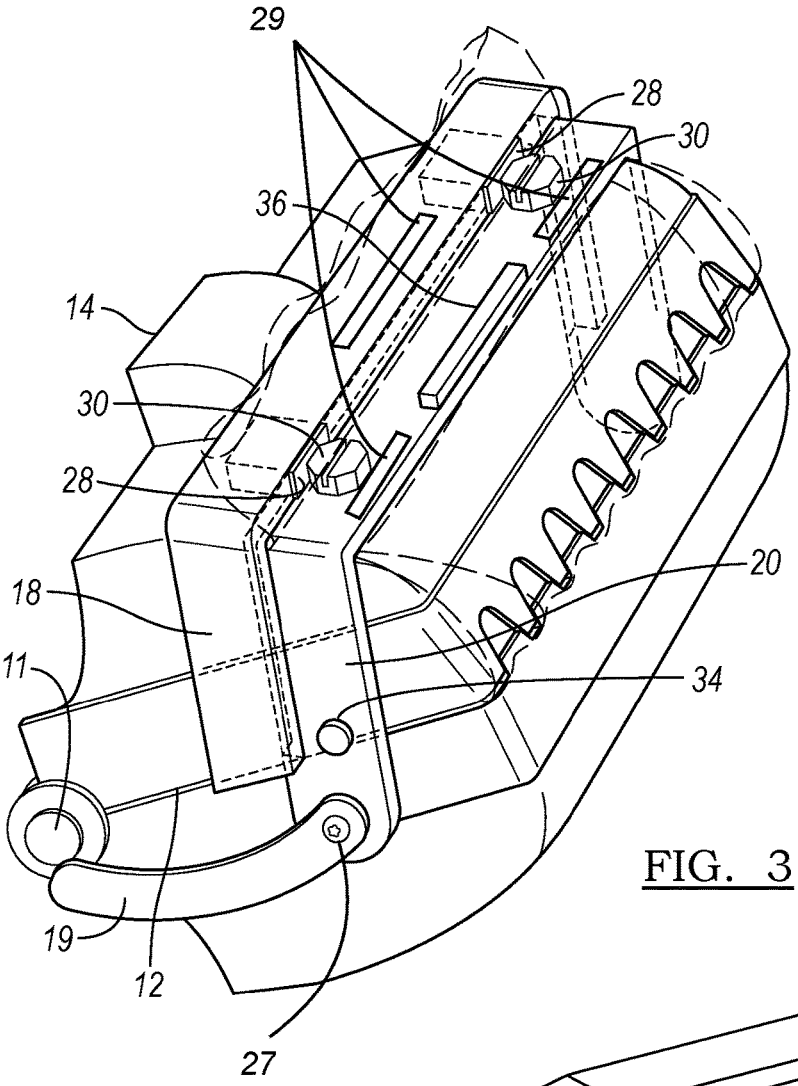
FIG. 3 shows a side view one embodiment of the disclosed device in its closed position.

Turning now to FIG. 3, this figure depicts one embodiment of the claw in its second, closed position. In this position, the advancing member 20 and the receiving member 18 are depicted contacting each other, in their second, contacted position. Similarly, the two appendages 12 are also depicted in their second, mated position, where they touch along a shared edge. The appendages 12 may be connected to each end of the cross-bar 10 by fixing each appendage 12 to a washer and securing them to the cross-bar 10 with another washer 11.

An embodiment of the bag sealer is also depicted in FIG. 3 and includes the receiving member 18, the advancing member 20, and the actuator 19. As with the appendages 12 which touch along a shared edge when the claw is in its second position, the advancing member 20 and receiving member 18 similarly touch along a shared edge when mated in their second position. The advancing member 20 in this embodiment may be attached to an appendage 12 with a fastening piece which fits through an aperture in both the advancing member 20 and the appendage 12, and which fastens the two pieces together while still permitting the advancing member 20 to pivot about the fastening piece.

Additionally, FIG. 3 depicts a protrusion 34 fixed immovably to the surface of the advancing member 20 and an actuator 19. The actuator 19 in this embodiment may comprise an aperture and may be fastened to the advancing member 20 with the same fastening piece that secures the advancing member 20 to one appendage 12. The actuator 19 is thus able to freely pivot such that it can firmly contact the protrusion 34 and move the advancing member 20 forward in some positions. Some embodiments also may comprise a flange 36 attached to the advancing member 20 which causes the advancing member 20 to return from its second position back to its first position when the advancing member 20 is not secured to the receiving member 18. Similarly, some embodiments may comprise a retracting member 27 secured to the actuator 19 and the advancing member 20, which causes the actuator 19 to return from its second position back to its first position when the user of the device is not applying a force to the actuator 19. This retracting member 27 is attached to both the advancing member 20 and the appendage 12 to which the advancing member 20 is attached.

Returning to FIG. 2, in the embodiment depicted in that figure, the receiving member 18 comprises a groove 32, configured to receive a portion of the advancing member's edge when the advancing member 20 and receiving member 18 are in their second, contacted position, as shown in FIG. 3. Additionally, the embodiment depicted in FIG. 2 comprises magnetic portions on the receiving member 28 and magnetic portions on the advancing member 30 which cause the advancing member 20 and the receiving member 18 to releasably secure to each other when they are in the second, mated position.

Figure 4:
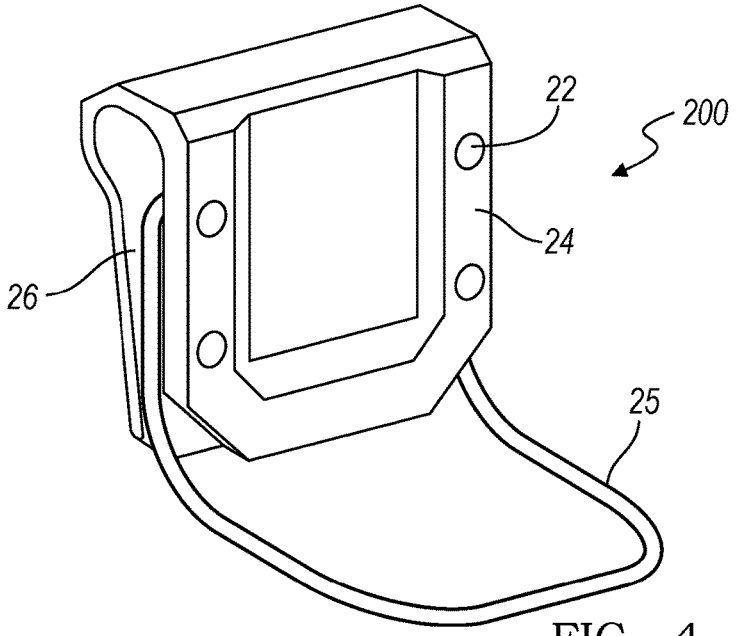
FIG. 4 shows a front view of one embodiment of the disclosed holster.

FIG. 4 is a diagram of the holster 200, which is also shown in FIG. 1. In this embodiment the holster's 200 first portion 24 is configured to magnetically attach to and detach from the claw 100, and its second portion 26 is a clip configured to releasably attach the holster 200 to a user's belt. As with the claw 100, the holster 200 may comprise magnetic pieces 22 which enable it to magnetically attach to other objects. The holster 200 may comprise a protective member 25 extending a sufficient distance from the holster's 200 second portion 26 to shield the claw 100 when the claw 100 is secured to the holster 200.

In use, the disclosed claw 100 may be detached from the holster 200, as shown in FIG. 1. The user may pull a disposable bag out from within a bag dispenser 15 fixed to the base of the claw 100. The user may invert the disposable bag around the exterior of the claw 100, as depicted in FIG. 2. If the exterior of the claw 100 has adhesive portions 29 fixed to it, these adhesive portions 29 may aid in holding the bag in place.

Returning to FIG. 1, the user may place the fingers of his operative hand into a receptacle 16 on the first appendage 12 of the claw and his thumb into the receptacle 14 on the second appendage 12 of the claw. With his operative hand inside the claw, the user may open the claw over the waste and close the claw around the waste. At this point, the waste would be secured inside the disposable bag, and a portion of the disposable bag containing the waste would be secured inside the closed claw.

In order to secure the claw in the closed position, as shown in FIG. 3, the user may push the actuator 19 forward until it contacts the protrusion 34 and forces the advancing member 20 to contact the receiving member 18. Finally the user may reattach the claw to the holster and remove his operative hand from the claw's receptacles 14, 16. At a later point, the user may again detach the claw from the holster and may use a flange 36 on the advancing member 20 to pull the advancing member 20 away from the receiving member 18, thus permitting a user to release the claw from being secured in the closed position. Finally, the user may pull the appendages 12 of the claw apart and remove the disposable bag containing the waste.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A collection device comprising:

a claw comprising a base region and appendages, wherein each appendage has a proximal end and a distal end and an exterior surface, the proximal ends of the appendages are connected to each other at the base region of the claw, one each appendage has a receptacle configured to accommodate a part of a user's hand, and the claw is operable between a first and second position, wherein in the first position the distal ends of the appendages are not contacting each other and in the second position the distal ends are contacting each other; and a bag sealer comprising a receiving member fixed to the exterior surface of a first of the appendages and an advancing member fixed to the exterior surface of a second of the appendages, wherein the receiving member and the advancing member are releasably securable to each other, wherein the advancing member is configured to pivot between a first and second position.

2. The collection device of claim 1, wherein in the first position the advancing member is not touching the receiving member, and wherein in the second position the advancing member is releasably secured to the receiving member.

3. The collection device of claim 1, wherein the advancing member can be is configured to be releasably secured to the receiving member with a magnet.

4. The collection device of claim 1, wherein the claw has an exterior surface; and a portion of which is configured to releasably secure the claw to another object.

5. The collection device of claim 4, wherein the portion of the exterior surface of the claw is a magnet.

6. The collection device of claim 1, further comprising an actuator fixed to the exterior surface of an appendage operable between a first position and a second position, wherein the actuator moves the advancing member of the bag sealer as the actuator moves between the first position and the second position.

7. The collection device of claim 1, further comprising an exterior surface on the claw; and an actuator fixed to the exterior surface of the claw operable between a first position and a second position, wherein the actuator moves the advancing member of the bag sealer as the actuator moves between the first position and the second position.

8. The collection device of claim 1, further comprising an exterior surface on the claw; and an actuator fixed to the exterior surface of the claw wherein the actuator pivots between a first position and a second position, wherein the actuator moves the advancing member of the bag sealer as the actuator pivots between the first position and the second position.

9. The collection device of claim 1, further comprising flange secured to the advancing member, wherein the flange causes the advancing member to return from its second position back to its first position when the advancing member is not secured to the receiving member.

10. The collection device of claim 1, further comprising a retracting member secured to an actuator and the advancing member, wherein the retracting member causes the actuator to return from its second position back to its first position when the user of the device is not applying a force to the actuator.

11. The collection device of claim 1, further comprising an exterior surface on the advancing member; and a flange protruding from the exterior surface of the advancing member.

12. The collection device of claim 1, further comprising an exterior surface on the claw; and a plurality of adhesive portions fixed to the exterior surface of the claw.

13. The collection device of claim 1, further comprising a bag dispenser fixed to the base region of the claw with an aperture on the surface of the dispenser which is configured to receive a roll of bags.

14. A collection device comprising:

a claw comprising a base region and appendages, wherein each appendage has a proximal end and a distal end and an exterior surface, the proximal ends of the appendages are connected to each other at the base region of the claw each appendage has a receptacle configured to accommodate a part of a user's hand, and the claw is operable between a first and second position, wherein in the first position the distal ends of the appendages are not contacting each other and in the second position the distal ends are contacting each other;

a bag sealer comprising a receiving member fixed to the exterior surface of a first of the appendages and an advancing member fixed to the exterior surface of a second of the appendages, wherein the receiving member and the advancing member are releasably securable to each other;

a holster comprising a first portion capable of releasably securing the claw and a second portion configured to releasably secure to another object; and a protective member extending a sufficient distance from the holster's second portion to shield the claw when the claw is secured to the holster.

15. The collection device of claim 14, wherein the holster's first portion comprises a magnetic portion.

16. The collection device of claim 14, wherein the holster's second portion is configured to releasably secure the holster to an article of clothing.

17. A collection device comprising:

a claw comprising an exterior surface, a base region, and a first and second appendage, wherein each appendage has a proximal end and a distal end, and the proximal ends of the appendages are fixed to the base region of the claw, and wherein the first appendage comprises a receptacle sized to accommodate a user's fingers and the second appendage comprises a receptacle sized to accommodate a user's thumb, and the appendages can be brought toward each other at their distal ends by a movement of a user's operative hand, and the claw is operable between a first and second position, wherein in the first position the distal ends of the appendages are disunited and in the second position the distal ends are united; and a receiving member on the exterior surface of the first appendage and containing a magnetic portion and a groove;

a locking lever attached to the exterior surface of the second appendage comprising a magnetic portion and operable between a first position and a second position, and wherein the locking lever rests inside the groove of the receiving member in the second position and away from the receiving member in the first position;

a bag dispenser fixed to the base region of the claw with an aperture on the surface of the dispenser which can receive a roll of bags;

a plurality of adhering pieces fixed to the exterior surface of the claw capable of adhering to a bag; and a holster comprising a magnetic portion capable of securing the claw and a thin piece of rigid material capable of releasably securing the holster to a belt.

* * * * *